US005239745A

United States Patent [19]

Hofsäss

[11] Patent Number: 5,239,745

[45] Date of Patent: Aug. 31, 1993

[54] METHOD FOR THE MANUFACTURE OF FINISHED SELF-STABILIZING RESISTORS

[76] Inventor: Peter Hofsäss, Strietweg 45, D-7530 Pforzheim, Fed. Rep. of Germany

[21] Appl. No.: 835,352

[22] Filed: Feb. 14, 1992

[30] Foreign Application Priority Data

Feb. 15, 1991 [DE] Fed. Rep. of Germany ..... 4104709

[51] Int. Cl.[5] ..... H01C 17/28

[52] U.S. Cl. ..... 29/621; 29/612; 338/22 R; 338/332

[58] Field of Search ..... 29/612, 621; 338/22 R, 338/322, 332

[56] References Cited

U.S. PATENT DOCUMENTS

| | | | |
|---|---|---|---|
| 2,659,871 | 11/1953 | Berg | 338/322 |
| 3,117,297 | 1/1964 | De Gier | 29/621 |
| 3,322,655 | 5/1967 | Garibotti et al. | 29/621 |
| 4,926,542 | 5/1990 | Bougger | 29/621 |

FOREIGN PATENT DOCUMENTS

| | | | |
|---|---|---|---|
| 11701 | 1/1991 | Japan | 338/22 R |
| 411512 | 6/1934 | United Kingdom | 338/332 |

*Primary Examiner*—P. W. Echols

*Attorney, Agent, or Firm*—Antonelli, Terry, Stout & Kraus

[57] ABSTRACT

For the manufacture of finished, self-stabilizing resistors, i.e. provided with leads, having PTC elements as the active parts, as well as such resistors, particularly on coil windings, such as those of electric motors, the invention provides a method according to which on a metallic carrier strip contact and top surfaces for the PTC elements are punched, a PTC element is placed and fixed to each contact surface, the top surface is bent over the PTC element, the contact and top surfaces are provided with leads and the top and contact surfaces are separated from the remaining carrier strip.

20 Claims, 4 Drawing Sheets

METHOD FOR THE MANUFACTURE OF FINISHED SELF-STABILIZING RESISTORS

FIELD OF THE INVENTION

The invention relates to a method for manufacturing finished, self-stabilizing resistors, particularly for use on coil windings, such as for electric motors, in which two facing lateral faces of a PTC element are electrically connected with leads, as well as a finished, self-stabilizing resistor, particularly for use on coil windings, such as for electric motors, with a flat PTC element and leads electrically connected thereto.

For monitoring electrotechnical devices, such as for example, monitoring coil windings of electric motors or the like, use is made of self-stabilizing resistors, which have PTC elements with which are connected electrical leads. The resistors are brought into close thermal contact with the electrical device such as the coil, e.g. the coil winding wire partly envelops the same. In order to be able to detect temperature changes over a larger area of the coil, such resistors are connected in series and fitted at different points of the winding. Generally, the leads are directly soldered to the PTC elements, which, for this purpose, are given a solderable metallic contact surface, such as an evaporated silver coating. Generally, the leads are manually soldered. This is time-consuming and complicated, particularly if very small PTC elements are used, which have heights less than 2 mm and diameters of less than 5 mm and down to 3 mm. The remaining production also takes place manually and the shrunk-on sleeves are also produced by hand, so that manufacturing costs are considerable.

SUMMARY OF THE INVENTION

The aim uderlying the invention essentially resides in providing a method of the aforementioned type, which permits an economic and inexpensive manufacturing of finished, self-stabilizing resistors.

According to the method of the present invention, stamped or punched onto a metallic carrier or support strip are contact and top surfaces for the PTC elements, one PTC element is placed and fixed on each contact surface, the top surface is bent over the PTC element, the contact and top surfaces are provided with leads and the top and contact surfaces are separated from the remaining carrier strip. A novel finished, self-stabilizing resistor differs from known resistors in that on opposite faces of the PTC elements are soldered sheet metal plates (contact and top surfaces), which have lugs or shoulders projecting over the PTC element and to which the leads are fixed.

The invention provides a method, which permits a substantially automated and therefore mechanical production of such finished, self-stabilizing resistors and which therefore reduces or almost eliminates the use of manual work.

According to the inventive method, the PTC elements, which constitute parts which are individually difficult to manually produce, are held and conveyed during the production process by a quasi-endless carrier strip and at least until the PTC elements are connected to the leads, followed by belting in a per se known manner. The further automatic conveying can then take place in a clearly defined form and with a clearly defined relative spacing of the PTC elements by the belts acting on the leads.

Thus, the PTC elements are held in a clearly defined manner and all the machining and processing operations can be performed completely automatically in stations of a machining apparatus. The supply of the PTC elements to the continuous carrier strip can take place from a jolting cup by means of a chute having a check valve. The chute ends directly upstream of the contact surface for a PTC element on the carrier strip. If such a contact surface is conveyed upstream of the chute, the check valve can release a PTC element, so that it can slide onto the contact surface. The others are then held back by the valve or corresponding valves. Positioning pins can be provided, which centre the PTC element on the contact surface. Alternatively grippers can be provided, which grip the PTC elements and place them on the contact surface. After placing a PTC element on a contact surface, a top surface is brought above the same, so that the PTC element is defined in sandwich-like manner by the contact and top surface. If solder has been applied beforehand to the contact and top surface, the PTC element can now be soldered to the contact and top surface. Use is also made of PTC elements having a metallic contacting. Soldering can take place by high frequency. The PTC elements are then firmly connected to the carrier strip and are conveyed by the latter to the further processing and machining stations.

According to a preferred development lugs can be punched from the contact and top surface for the fixing of the leads. This facilitates the fixing, preferably welding, of the leads to the contact and top surface for the proeuction of electrical contacts to the PTC element. For positioning the leads prior to the fixing to the contact and top surface, particularly on the lugs thereof, according to a preferred development edges of the lugs are bent vertically therefrom.

So that on bending over the top surface, which has been punched or stamped from the carrier strip in the same way as the contact surface, but is still connected thereto by clips, said top surface rests flat on the PTC element, before said top surface is bent over the PTC element it can be bent out of the carrier strip, whilst remaining parallel thereto. The displacement of the top surface with respect to the carrier strip plane substantially corresponds to the thickness of the PTC element.

According to a further development, following the firm connection of the PTC element to the contact and top surface, initially only the latter is separated from the remaining carrier strip. Despite the separation of the top surface from the carrier strip, the latter continues to be held, because it is firmly connected to the PTC element. As a result of this procedure the contact surface and the top surface are electrically separated or isolated from one another. According to a preferred development, following an electrical isolation of the contact and top surface, an electrical testing of the PTC element takes place. An important test of the PTC element used consists of it being checked under use temperature conditions with respect to its conductivity or electrical resistance. For testing the PTC element on the carrier strip passage takes place through a thermostatic bath, particularly an oil bath. For electrical contacting purposes contact pins are brought against the top and contact surface. The lugs to which the leads will be subsequently fixed are useful here, particularly if they are oriented parallel to one another, but are displaced in plan view. Thus, in this case the contact pins can be pressed parallel from top to bottom against the lugs. This makes it possible to pass the carrier strip horizontally through the thermostatic bath. There is no need to pass a contact pin from below through the bottom of the thermostatic bath, which would require complicated sealing. It is also not necessary to in any way connect the carrier strip to bring it into a vertical orientation, so that contact pins could move horizontally from both sides against the contact and top surface. Problems would also be encountered in connecting the carrier strip or in vertically conveying the same, at least over partial areas, inter alia due to the inherent rigidity of said strip.

PTC elements recognized as being defective by the inspection or testing operation could then be removed from the carrier strip and eliminated by providing at a corresponding clock step distance from the testing device a punching off device and subsequently with a number of feed clocks corresponding to the distance the corresponding PTC element is eliminated by punching the connecting link from the carrier strip.

In simple manner a single lead can be fixed to each of the lugs on the contact and top surface. However, there can also be series connections of two or more PTC elements. For this purpose, prior to the series connection of two PTC elements, one end of a wire portion is connected to the top surface of the first PTC element and the other end of the wire portion is connected to the contact surface of the immediately following PTC element and the contact surface of the first PTC element and the top surface of the second PTC element are in each case provided with wire strands or for the series connection of three PTC elements in each case the first end of a wire is connected to the top surface of a preceding PTC element and the second end of the wire is connected to the immediately following PTC element and the contact surface of the first PTC element and the top surface of the third PTC element are provided with wire strands.

As stated, in a following operation and after fixing the leads, the latter can be belted.

On the belt the thus far produced resistors are conveyed for further working and this can consist of the PTC elements connected to the contact and top surface and provided with wires or leads being given an insulating layer and in particular through the PTC elements connected with the contact and top surface being given a powder coating. It is also possible to engage and shrink on a shrink sleeve.

Other advantages and features of the invention can be gathered from the claims and the following description of a non-limitative embodiment with reference to the attached drawings, wherein show:

DETAILED DESCRIPTION

Figure 1:
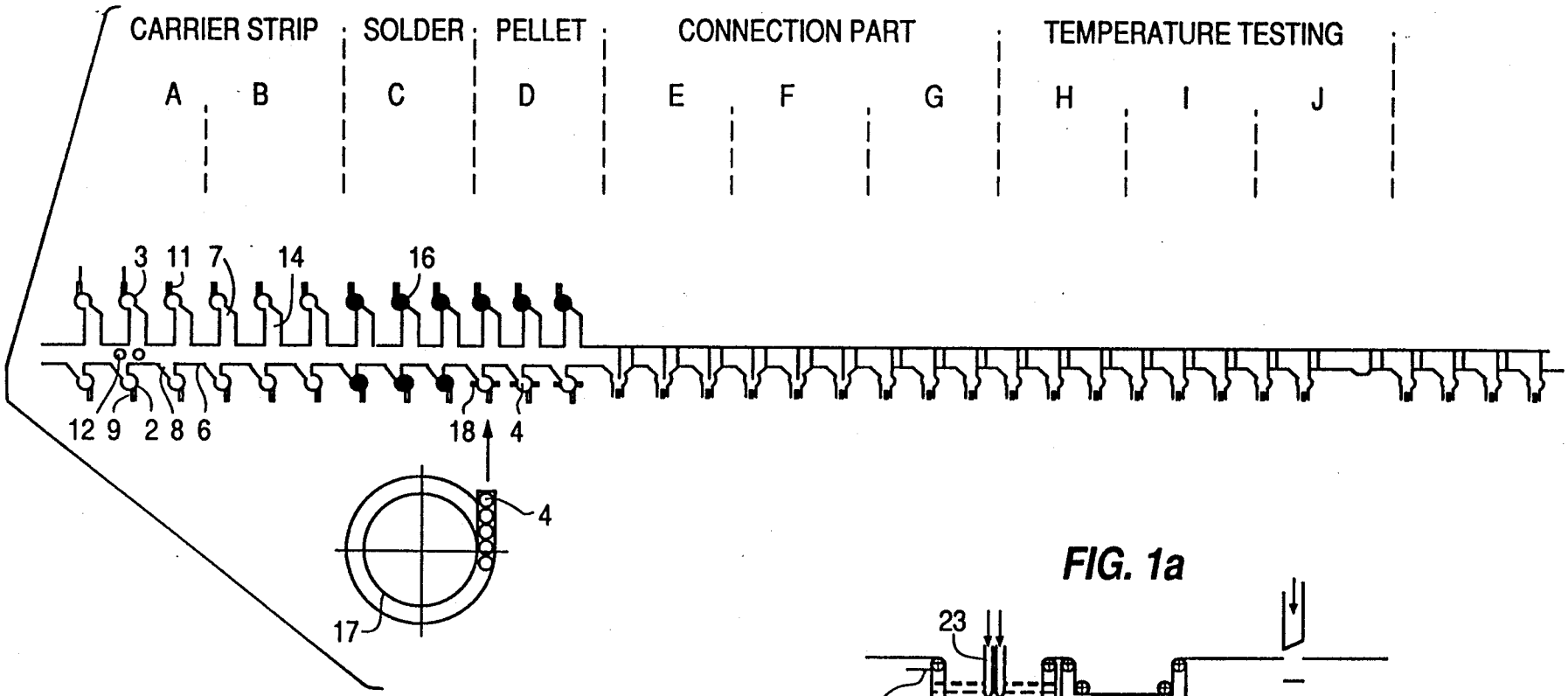
FIG. 1 is a diagrammatic view of initial working steps of the method in accordance with the present invention.

The inventive method for producing finished, self-stabilizing resistors for use on coil windings such as electric motors is based on a continuous, thin sheet metal carrier strip 1. From the latter are punched contact surfaces 2 and top surfaces 3 for PTC elements 4, which are also held on a narrow retaining strip 6 by means of connecting portions 7,8 extending therefrom (method step A). On the contact and top surfaces 2,3 extend substantially tangential lugs or shoulders 9,11 for the subsequent receiving and fixing of leads. In addition, from the retaining strip 6 are punched openings 12 enabling, during the further processing, a precise positioning of the retaining strip 6 and therefore also the top and contact surfaces 2,3.

This is followed by stamping from the plane of the carrier strip 1 (step B). Edges 13 (FIGS. 2*a,b*) of the lugs 9,11 are bent upwards in the plan view of FIG. 1. The top surface 3 is displaced so far from the plane of the carrier strip, but still parallel thereto, as corresponds to the thickness of the PTC element 4. The top and contact surfaces 2,3 can still have a plate or dish-like construction, as can be gathered from FIG. 2*b*, i.e. edges 14 are formed, which can circumferentially pass round and centre the PTC element 4. In a further step C solder 16 is applied to the top and contact surfaces 2,3.

Figure 1A:
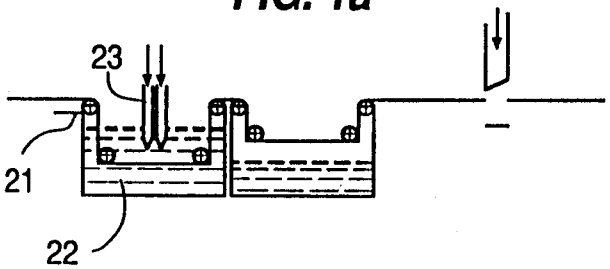
FIG. 1*a* is a side view of a carrier strip during a dipping process.
Figure 2B:
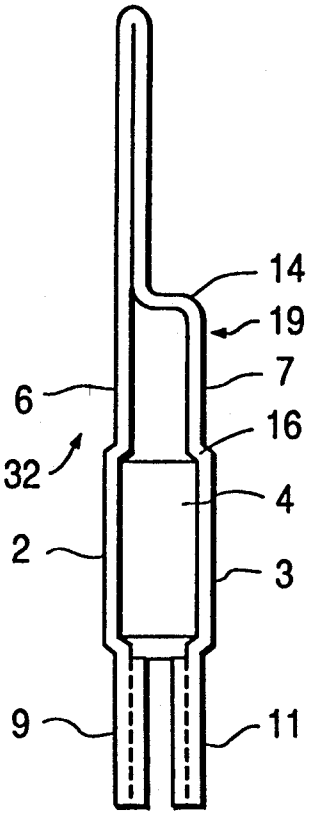
FIG. 2*b* is a side view, on an enlarged scale, of the PTC element and contact and top surface prior to the separation of the PTC element from the carrier strip.
Figure 2A:
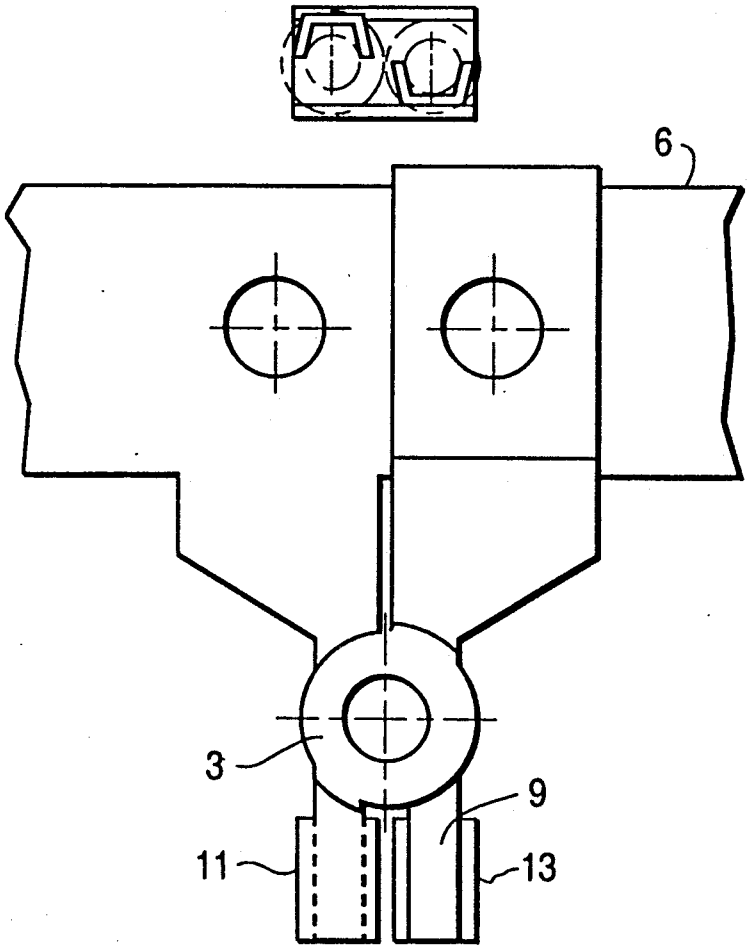
FIG. 2*a* is a plan view of a PTC element and contact and top surface prior to separation of the PTC element from the carrier strip.

A PTC element in the form of a PTC pellet is then placed on the solder-equipped contact surface. The PTC elements can be provided on a jolting cup 17 and are either taken up by a gripper and placed on the contact surface 2 or are supplied by a chute and an exposable stop to the contact surface 2. For positioning the PTC elements 4, beside the contact surface 2 can be provided positioning pins 18 which, when a further contact surface 2 comes into the vicinity thereof, are moved upwards and receive between them the PTC element 4. Then, in step E, the connecting portion 7 carrying the top surface 3 is bent around in such a manner that the top surface 3 is brought precisely over the PTC element 4. The result of this step is shown in FIGS. 2*a* and 2*b*. In the following step F soldering takes place between the PTC element 4 and the contact and top surfaces 2,3 with the previously applied solder 16. Soldering preferably takes place with high frequency, i.e. using a high frequency generator. Following the fixing of the PTC element 4 to the contact surface 2 in this way and therefore also the fixing of the top surface 3 over the PTC element 4, the connecting portion 7 can be removed from the carrier strip 6, e.g. at the point designated 19 (FIG. 2*b*). This takes place in method step G. The contact surface 2 with the retaining strip 6 and the top surface 3 are then electrically separated, i.e. no longer form a short-circuit connection. To check the quality of the PTC element the carrier strip 6 is now diverted by rollers 21 (FIG. 1*a*) into an oil bath 22 for testing the resistance at a predetermined temperature and the resistance is tested by contact pins 23 which are moved against the leads 9,11. Degreasing (step I) takes place and faulty PTC elements are cut off (step J), with the faults being detected in the previously described testing and inspection process.

Figure 3:
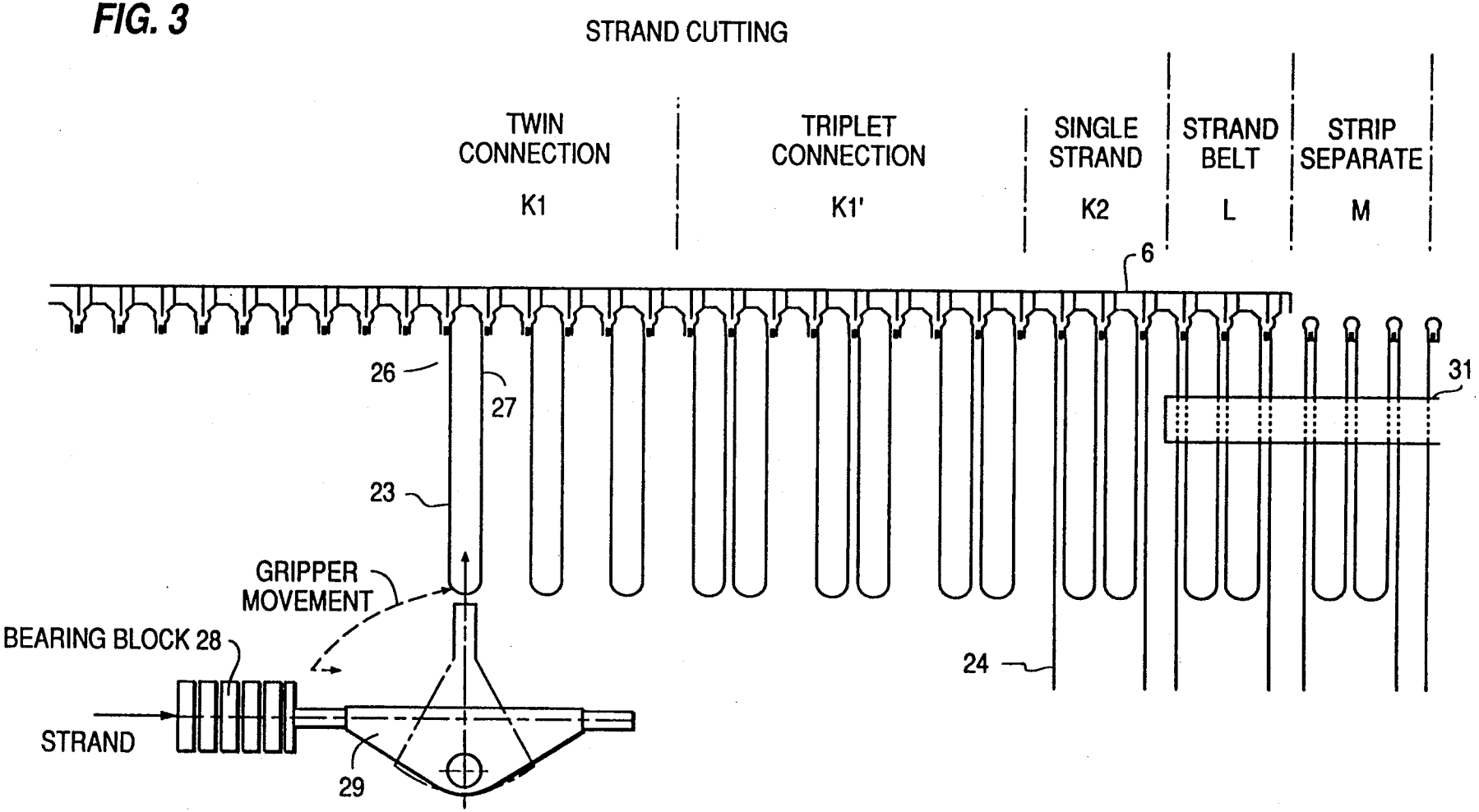
FIG. 3 is a diagrammatic view of further inventive method steps of the present invention.
Figure 4:
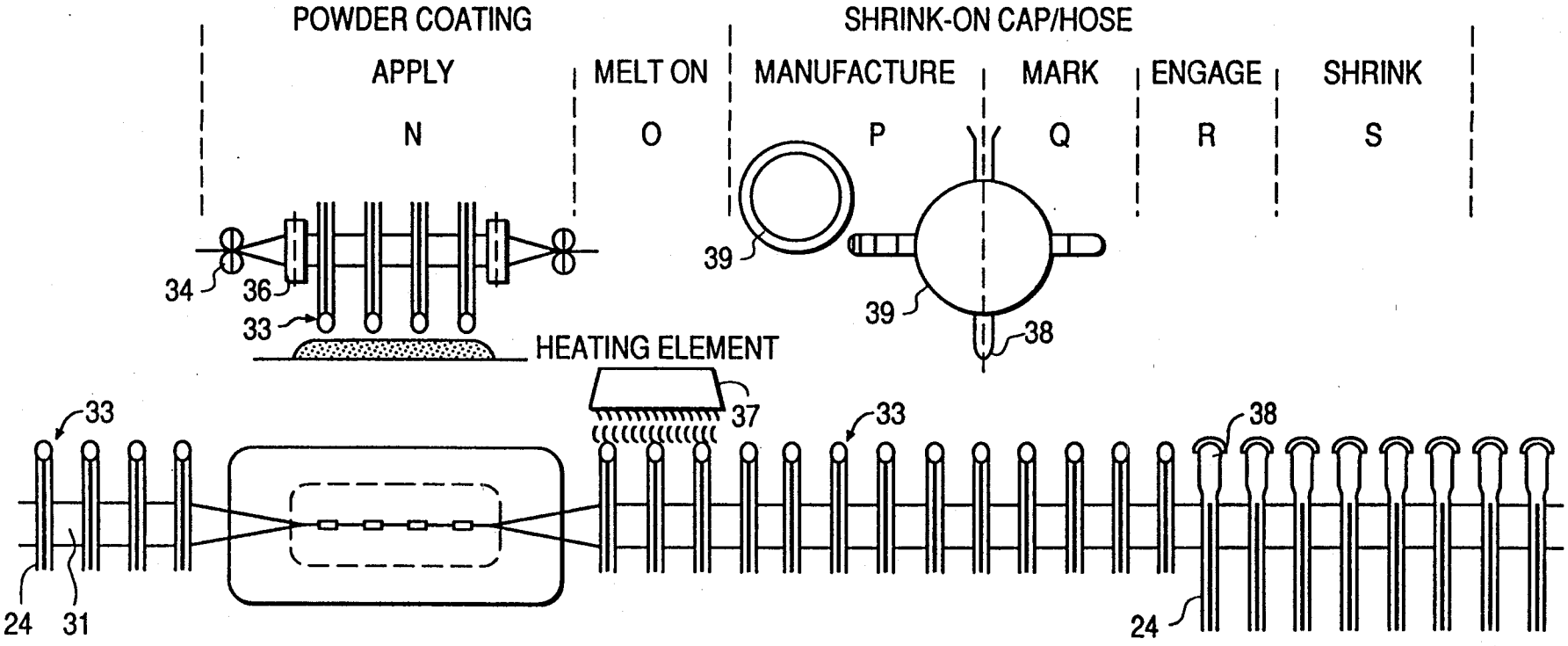
FIG. 4 is a diagrammatic view of a finishing operation in accordance with the method of the present invention.

The lugs 9,11 are then provided with corresponding leads 23,24 (FIG. 3). If several PTC elements 4 are to be connected in series, e.g. two PTC elements in a twin connection or three PTC elements in a triplet connection, then in the manner shown in FIG. 3, the ends 26,27 of a wire 23 bent in U-shaped manner are on the one hand connected to the lug 11 of the top surface 3 of a PTC element (end 27) and on the other hand the end 26 is connected to the lug 9 of the contact surface 2. The wire ends 26,27 are preferably welded to the lugs 9,11 (step K1). Step K1' shows how three successive PTC elements are connected in series by two leads bent in U-shaped manner. In step K2 the individual strands 24 are fixed to the free lugs 9 or 11. The leads 23 are prepared in such a way that, on being removed from a wire roll, there is firstly an adequate bearing or stripping of the front wire end in a stripping or bearing block 28 and then the wire is conveyed on along two aligned grippers 29, which can be pivoted relative to one another. On reaching the necessary wire length, the wire portion 23 is separated from the remaining wire and bearing is also carried out at the rear end 26. The grippers 29 are pivoted against one another and thereby bend the wire portion 23 into the U-shape shown at the start of FIG. 3 and the start 27 and end 26 of the wire pass into the parallel orientation shown.

Following the fitting of the leads 23,24, they are preferably belted, e.g. enclosed between two adhesive tapes, which can take place in conventional manner (step L). As the leads 23,24 and via these the PTC elements are now held by the belts 31, said PTC elements can be completely separated from the carrier strip 6, in that there is a complete separation at 32 (FIG. 2*b*—step M).

The resulting self-stabilizing resistors can be supplied to the further processing steps. It is possible for a coating to take place, e.g. a potting or a powder coating. In the latter case, in method step N the initially horizontally conveyed resistors 33 are pivoted by 90°, so that the leads point upwards. This is brought about in that the belt 31 is passed between pairwise arranged rollers 34,36, which are perpendicular to one another. The resistors 33 are passed through a powder bath. The adhesion of the powder is subsequently melted by heat, which can be produced by a radiating element 37, followed by cooling and the formation of a dense coating (step O). A shrink-on cap 38 can then be placed over the resistors 33. It is separated from a continuous tube 39 (step P), its free end can be optionally closed and provided with a marking (step Q). It can be supplied to a circular conveyor 39. It is then engaged on the self-stabilizing resistors 33 (step R). This can be followed in step S by a shrinkage process, so that the shrunk-on cap 38 tightly envelops the resistor 33 and then the leads 23,24 can be shortened.

I claim:

1. Method for manufacturing finished self-stabilizing resistors, in which two facing lateral surfaces of a PTC element are electrically connected to leads, the method comprising the steps of:

punching contact and top surfaces on a metallic carrier strip for accommodating the PTC element, placing and fixing a PTC element on each contact surface, bending the top surface over the PTC element, so as to contact a PTC element, providing the contact and top surfaces with leads, and separating the contact and top surfaces from the remaining portion of the metallic carrier strip.

2. Method according to claim 1, wherein the step of punching includes punching lugs extending from the contact and top surfaces for fixing the leads.

3. Method according to claim 2, wherein edges of the lugs are bent perpendicular to a part of the lug remaining between the edges.

4. Method according to one of claims 1 or 2, wherein the step of punching includes bending the top surface, before being bent over the PTC element, out of a plane of the metallic carrier strip, while remaining parallel thereto.

5. Method according to one of claims 1 or 2, wherein the step of placing and fixing includes connecting the PTC elements to the contact and top surfaces by soldering.

6. Method according to claim 5, wherein, prior to the placing of the PTC elements to the contact surface, the solder is applied to the contact surface and to the top surface.

7. Method according to claim 5, wherein, after the connection of the PTC element to the contact and top surfaces, initially only the top surface is separated from a remaining portion of the metallic carrier strip.

8. Method according to claim 1, further comprising the step of electrically checking and inspecting the PTC elements following the separating of the contact and top surfaces.

9. Method according to claim 8, wherein the step of checking and inspecting includes passing the PTC element on the metallic carrier strip through a thermostatic bath.

10. Method according to claim 9, wherein the thermostatic bath is an oil bath.

11. Method according to claim 8, further comprising the step of separating faulty PTC elements from the metallic carrier strip.

12. Method according to claim 1, wherein the leads are connected to the contact and top surfaces by welding.

13. Method according to claim 12, wherein the leads are welded to the lugs.

14. Method according to claim 1, wherein, for a series connection of two PTC elements, the method further comprises the step of connecting one end of a lead to the top surface of the first PTC element and the other end of the lead to the contact surface of an immediately following PTC element, and providing the contact surface of the first PTC element and the top surface of the second PTC element, in each case, with individual leads.

15. Method according to claim 1, wherein, for a series connection of three PTC elements, in each case, the method further comprises the steps of connecting a first end of one lead to the top surface of a preceding PTC element and a second end of the lead to an immediately following PTC element, and providing the contact surface of the first PTC element and the top surface of the third PTC element with individual leads.

16. Method according to claim 1, further comprising the step of belting the PTC elements after fixing the leads.

17. Method according to claim 16, wherein the step of separating is effected subsequent to the step of belting the PTC elements.

18. Method according to claim 1, further comprising the step of providing an insulating layer on the PTC elements connected to the contact and top surfaces and provided with leads.

19. Method according to claim 18, wherein the PTC elements connected to the contact and top surfaces are provided with a powder coating.

20. Method according to claim 1, wherein a shrink-on sleeve is engaged and shrunk onto the PTC elements connected to the contact and top surfaces and provided with leads.

* * * * *